US006870514B2

(12) United States Patent
Simpson

(10) Patent No.: US 6,870,514 B2
(45) Date of Patent: Mar. 22, 2005

(54) COMPACT MONOPOLE ANTENNA WITH IMPROVED BANDWIDTH

(75) Inventor: Robert G. Simpson, Ellicott City, MD (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/465,564

(22) Filed: Jun. 20, 2003

(65) Prior Publication Data

US 2004/0160380 A1 Aug. 19, 2004

Related U.S. Application Data

(60) Provisional application No. 60/447,322, filed on Feb. 14, 2003.

(51) Int. Cl.[7] ..... H01Q 1/48

(52) U.S. Cl. ..... 343/846; 343/752; 343/860; 343/899

(58) Field of Search ..... 343/752, 789, 343/828–831, 846, 860, 899

(56) References Cited

U.S. PATENT DOCUMENTS 5,539,418 A * 7/1996 Egashira et al. ..... 343/712

OTHER PUBLICATIONS

Foltz et al. "Disk–Loaded Monopoles with Parallel Strip Elements" IEEE Transactions on Antennas and Propagation, vol. 46, No. 12, Dec. 1998.

Friedman, "Wide–Band Matching of a Small Disk Loaded Monopole" IEEE Transactions on Antennas and Propagation, vol. AP–33, No. 10, Oct. 1985.

Goubau, "Multi–element Monopole Antennas" Proc. ECOM–ARO Workshop on Electrically Small Antennas, Fort Monmouth, NJ, May 6 and May 7, pp. 63–67.

* cited by examiner

*Primary Examiner*—Michael C. Wimer
(74) *Attorney, Agent, or Firm*—Shaw Pittman LLP

(57) ABSTRACT

A monopole antenna having a ground plane, a vertically extending feed line passing through a feed hole in the ground plane, a top hat in the shape of a disk connected to the feed line, the top hat being spaced from and extending over at least a portion of the ground plane, and a matching network disposed in a space between the top hat and ground plane, the matching network being arranged to effectively extend the feed hole in the ground plane. Such an antenna structure improves antenna bandwidth without increasing antenna volume or requiring external matching circuitry.

15 Claims, 3 Drawing Sheets

COMPACT MONOPOLE ANTENNA WITH IMPROVED BANDWIDTH

This application claims the benefit of U.S. Provisional Application No. 60/447,322, filed Feb. 14, 2003, which is incorporated herein by reference in its entirety.

BACKGROUND

1. Field of the Invention

The present invention is related to antenna design. More particularly, the present invention is related to antenna structures that are capable of increased operational bandwidth without a corresponding increase in antenna size.

2. Background of the Invention

In the design of an antenna, it is well known that the size of the antenna and the bandwidth over which it can operate are in competition. As the antenna dimensions are reduced below a half wavelength, bandwidth decreases quite rapidly. However, for applications like portable wireless communications and covert military scenarios, it is desirable to keep the antenna as compact as possible while meeting increasingly large bandwidth requirements for modern digital communications.

More specifically, wireless and mobile-wireless communications are a critical and expanding technology in both military and commercial markets. Efficient, compact antennas are crucial elements of these systems. Antenna arrays can be beneficial for base stations and vehicular applications, but for operations below 2 GHz, the required size for an array makes them unsuitable for handheld units and items like artillery-delivered, unattended ground sensors (UGS). Small antennas are also less conspicuous, a plus for UGS hoping for concealment as well as for commercial applications where cosmetic appearances are important.

In addition to size, the frequency bandwidth supported by these antennas is very important. Of course, the antenna must support the information bandwidth, which determines how much and how fast data can be exchanged. But it must also support the signal bandwidth, which may be increased by spread spectrum requirements. Moreover, radios such as the military's Joint Tactical Radio (JTR) are expected to actively alter their operating frequencies in response to the presence of other transmissions, further extending the frequencies over which the antenna must operate. The JTR is also expected to support simultaneous operation in several modes (voice, data, video), further increasing the demand for bandwidth. Finally, new technologies like ultra-wideband techniques for communications and sensing applications depend critically on receiving and transmitting broadband signals. There is a clear need for antennas that can handle broad ranges of the frequency spectrum.

Unfortunately, as mentioned above, broad bandwidth and small size are conflicting requirements for an antenna. Widely recognized performance bounds relating bandwidth and antenna size are well-known. Specifically, there is a bound on the amount of bandwidth that can be achieved as a function of antenna size. While quite helpful, available studies are silent on the question of how to construct an antenna element capable of operating near the performance bound.

The most successful attempts to date to construct small antennas with the widest possible bandwidths have involved variations on a monopole antenna that is top loaded with a disk like that illustrated in FIG. 1. Variants of this type of antenna have been investigated and reported in G. Goubau, "Multi-element monopole antennas," *Proc. ECOM-ARO Workshop on Electrically Small Antennas*, Fort Monmouth, N.J., May 6 and 7, 1976, G. Goubau and F. K. Schwering, Eds., pp. 63–67; C. H. Friedman, "Wide-Band Matching of a Small Disk-Loaded Monopole," *IEEE Trans. Antennas and Propagat.*, vol. AP-33, no. 10, October 1985; and H. D. Foltz, J. S. McLean and G. Crook, "Disk-Loaded Monopoles with Parallel Strip Elements," *IEEE Trans. Antennas and Propagat.*, vol. 46, no. 12, December 1998.

Foltz recently reported a scheme in which monopoles that were on the order of $\lambda/15$-tall yielded full-width half-power (FWHP) bandwidths of as much as 41% as compared to a theoretical upper bound of 50%. The −10 dB bandwidths were a more modest 10%. Foltz reported a second antenna designed for a different frequency band with, a 24% FWHP bandwidth as compared to a 34% theoretical upper bound and a 12% −10 dB bandwidth. Even these best results are 20% to 30% below the FWHM theoretical bound, leaving appreciable room for further improvement.

In his investigation, Foltz emphasized small size over bandwidth. For a doubling in the size of the antenna, the theory calls for a 5× improvement in bandwidth. Hence, it is believed that octave bandwidths with antennas shorter than $\lambda/7$ can be achieved. At 2 GHz, such an antenna would be less than an inch tall.

Foltz's solution is also commendable for realizing a second-order matching network within the antenna structure itself, as opposed to requiring additional tuning elements.

Despite the advances made in this field of antenna design, there remains a desire to further improve the performance of disk loaded, monopole antennas.

BRIEF SUMMARY OF THE INVENTION

The present invention provides at least two distinct features that differentiate it from prior-art monopole antennas. First, there is provided a structure that reduces the stored, or reactive, energy within a top hat structure so that the Q of the antenna is reduced and the bandwidth enlarged. Second, there is provided a new means for including wideband impedance matching structures within the antenna volume.

Previous work has always considered the drive point of the antenna to be located at the juncture between the antenna element and the ground plane. Previous improvements have come as a result of introducing some form of folded-dipole structure, in which there is more than one vertical conducting element. These multiple conductors are able to support multiple guided-wave modes. In the case of two modes, they are often referred to as the "transmission line mode" and the "antenna mode." The antenna mode is one in which the current flows in the same direction in all the vertical elements. This mode is responsible for producing the propagating wave that radiates from the antenna, or conversely that captures energy from an arriving wave when used for reception. The transmission line mode supports currents that flow in opposite directions in the various vertical conductors, in a manner similar to a transmission line. Because the currents flow in opposite directions, they produce essentially no radiation.

Embodiments of the present invention provide a monopole antenna with a top hat configuration including a unique matching network structure disposed beneath the top hat. The matching network structure is preferably in the form of a predominately vertically or horizontally extending series stub that enables broader bandwidth performance.

The foregoing and other features of the present invention will be more fully understood upon a reading of the following detailed description in conjunction with the accompanying drawings.

DETAILED DESCRIPTION OF THE INVENTION

Figure 2:
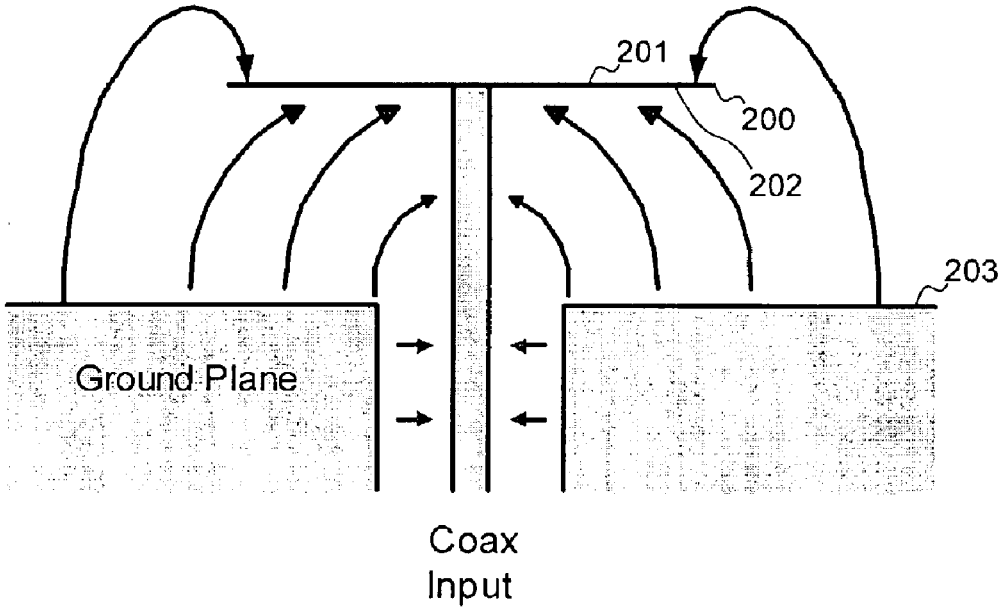
FIG. 2 is a cross section of a top hat antenna showing electric field lines.

The conventional notion regarding a monopole that is loaded at the top with a metallic disk is that the vertical currents produce the radiation and the top disk acts as a place to store charge so that more vertical current can flow than if the top disk were not present. However, in simulations, conducted by the present inventor, of the electric fields produced by a top disk-loaded monopole element, it has been observed that the radiated fields look as if they are associated with currents on the top side of the loading disk and currents on the ground plane at radii larger than the top disk radius. It has been further observed that in the region between the top disk and the ground plane, the fields behave much as one would expect in a radial transmission line. This behavior is sketched in FIG. 2, which, while described as a cross section is, as are the other drawings, more accurately described as a cross section through an object of revolution around its central axis. Specifically, the transition from the TEM coax mode to a radial transmission line mode generates higher order modes and additional stored energy that increases the Q and reduces the bandwidth of the antenna. Orientation of the electric field lines is indicated by the arrows.

These observations suggest that one could consider the antenna as a structure consisting of a top side 201 of top disk 200 and ground plane 203 out beyond the top disk radius. This structure can then be viewed as driven by a radial transmission line formed by a bottom side 202 of top disk 200 and ground plane 203 beneath the top disk.

Changing the perspective regarding the drive point offers the opportunity to reduce the stored or reactive energy associated with the antenna. This is important, because the ratio of the stored energy to radiated energy forms what is known as the Q of the antenna, and the smaller the Q, the larger the bandwidth. Hence, reducing the stored energy improves the bandwidth.

In accordance with the present invention the stored energy is reduced by removing a significant discontinuity between the aforementioned radial transmission line and the coaxial feed line that attaches to the antenna at the base of the vertical element. In the coaxial feed line, the electrical fields lie in the horizontal plane and point radially between the two coaxial conductors. In the radial transmission line, the electric fields are vertical. It is well known that when such discontinuities occur, other electromagnetic modes are stimulated. Such modes typically do not propagate well and die out within a short distance from the discontinuity. However, in the process, they represent stored energy and hence affect the Q of the antenna.

Figure 1:
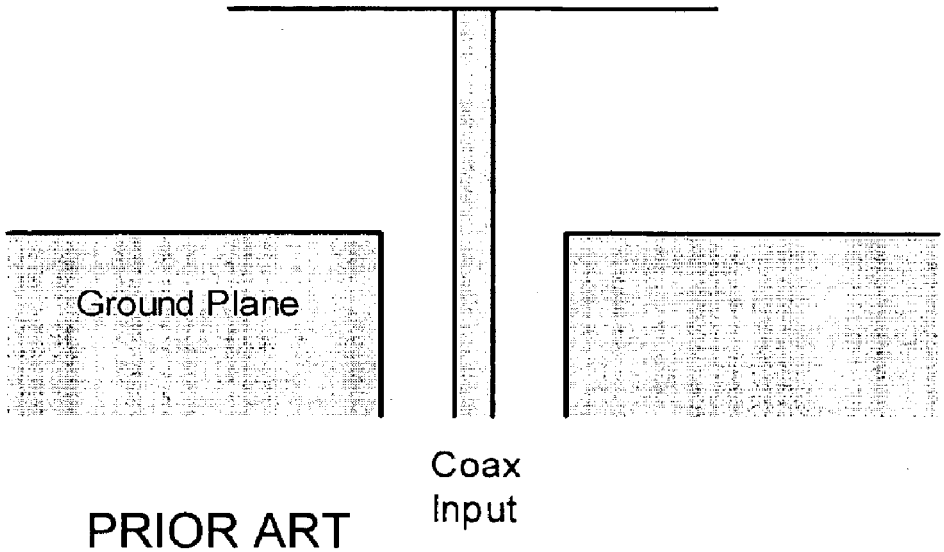
PRIOR ART FIG. 1
FIG. 1 is a cross sectional view of a prior art top hat antenna.
Figure 3:
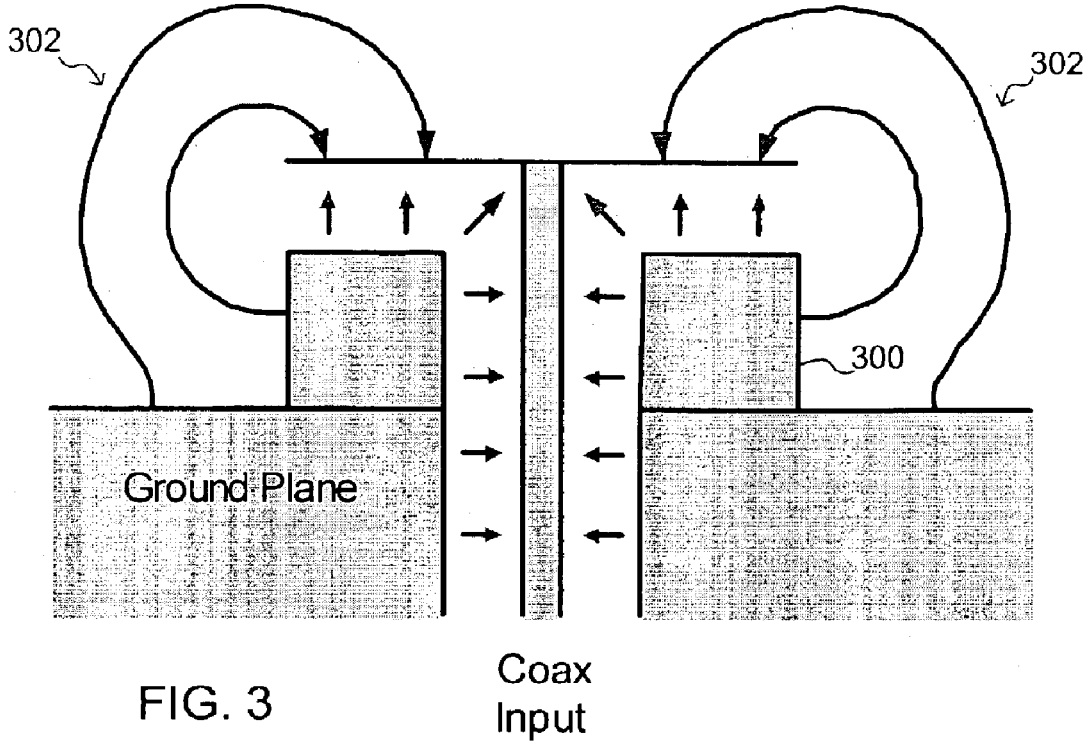
FIG. 3 is a cross sectional view of an antenna in accordance with a first embodiment of the present invention and the associated electric field lines.

In accordance with the present invention, the feed structure of an antenna like that shown in FIG. 1 is altered to reduce the amount of stored energy associated with the discontinuity between the input coax and the radial transmission line. In a first embodiment, according to the present invention, the feed coax's outer conductor is extended above the present ground plane. An extension 300 is shown in FIG. 3. Extension 300, in other words, can also be viewed as effectively extending a feed hole through which a feed line passes to feed the top disk. By making the conductor separation more similar in the coax line and the radial transmission line, less energy gets stored in the transition between them, reducing the Q and broadening the bandwidth.

In this case, the electric field 302 still has to bend in going from its original horizontal orientation in the coax to the vertical orientation in the radial feed line. However, there's a much less radical change in the separation between the conductors and hence less stored energy associated with this junction. Chamfering the edges of the bend would also assist in reducing the stored energy.

Just improving the Q is not enough to get the performance improvements that are sought. Recall that effective small antenna elements like those of Foltz are constructed so that there are two modes on the vertical conductors, an antenna mode and a transmission mode. The presence of this second mode has two favorable effects. It results in what is known as an impedance transformation and it broadens the bandwidth by what is known as double tuning.

When monopoles are much shorter than $\lambda/4$, the real part of their impedance, also referred to as the radiation impedance, can be small, on the order of only a few ohms. The impedance transformation effect boosts the impedance seen looking into the antenna at the drive point, making it easier to impedance match to a 50 ohm coaxial feed. The double tuning effect provides a means for sacrificing the very small (−50 dB) return losses near resonance in exchange for a wider bandwidth over which the return loss is still a respectable −10 or −15 dB. Recall that for a return loss of −14 dB, 96% of the applied power is being radiated and the VSWR is 1.5. The double tuning behavior is analogous to what happens when an equiripple matching network is designed using the techniques of Bode and Fano, which are best summarized in G. L. Matthaei, "Synthesis of Tchebycheff Impedance-matching Networks, Filters, and Inter-stages," *IRE Transactions on Circuit Theory*, pp. 163–172, September 1956.

Figure 4:
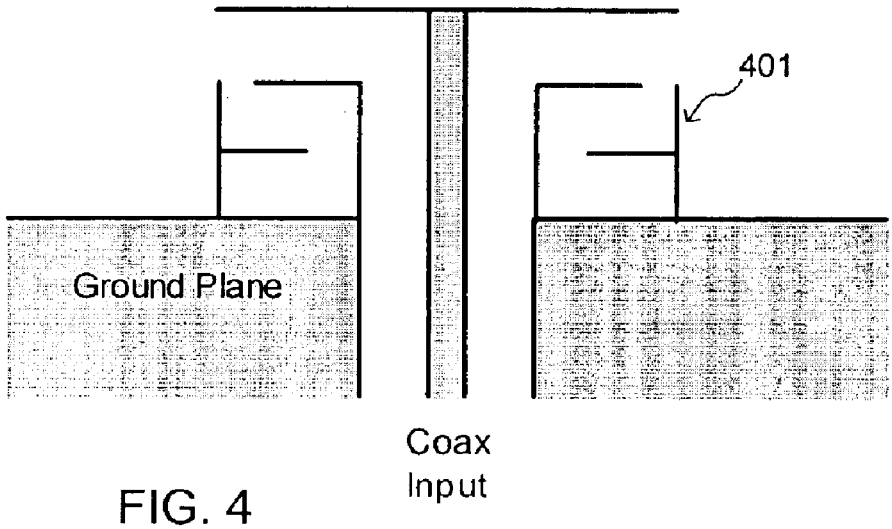
FIG. 4 is a cross sectional view of an antenna in accordance with a second embodiment of the present invention.
Figure 5:
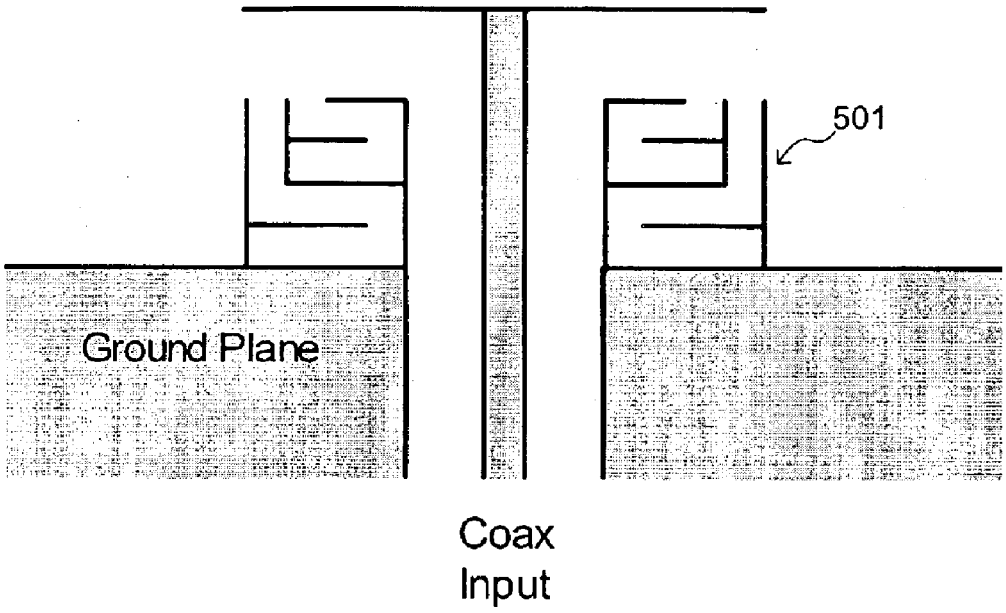
FIG. 5 is a cross sectional view of an antenna in accordance with a third embodiment of the present invention.

In moving the drive point out to the edge of the top disk, we no longer have the option of using multiple vertical conductors to create an antenna mode and a transmission line mode, as provided in the prior art. On the other hand, there is the volume of space between the top disk and the ground plane to put to better use. Of course, the radial feed line occupies some of this volume, but a lot remains. In accordance with the present invention, this region is used to introduce additional transmission line paths within this unused volume. In one embodiment, a transmission line path takes the form of a series stub 401, as illustrated in FIG. 4, attaching at the radial drive point. Or, in another embodiment, the transmission line path could take a more elaborate form 501, such as that indicated in FIG. 5. The more elaborate option of FIG. 5 allows for higher order tuning, akin to designing a higher order Tchebycheff matching network that has sharper band edges and more useful band bandwidth. These choices will depend on how things turn out with the impedances that exist at the radial drive point.

Figure 6:
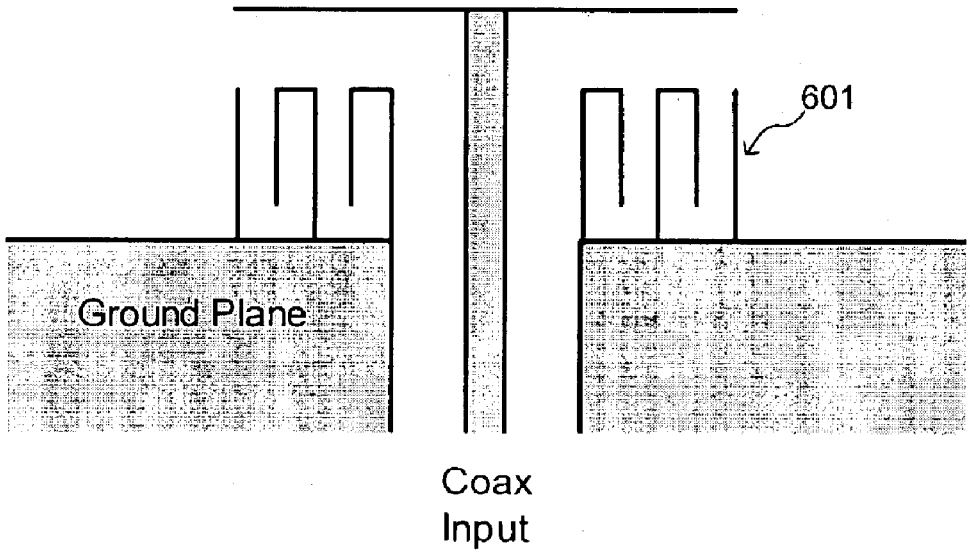
FIG. 6 is a cross sectional view of an antenna in accordance with a fourth embodiment of the present invention.

In addition to using matching stubs that are folded such that they act predominately as radial transmission lines, improved performance can be achieved by folding stubs 601 in a predominately vertical direction, as shown in FIG. 6. In the embodiment of FIG. 6, stubs 601 involve predominately vertical flow of the guided electrical wave as opposed to the radial flow achieved with structures of FIGS. 4 and 5. Nevertheless, the result is the same, namely a folded stub that can serve as an element in the matching network used to optimize the bandwidth or the impedance of the antenna. In this case, stub structure 601 looks more like a set of concentric coaxial cables, with appropriate connections between neighboring coaxes or appropriate open or short circuits at either the top or bottom ends of the various coaxial regions. Moreover, should one desire, the folded stubs could extend into the region presently indicated as ground plane. The stub structures are not restricted to lying above the ground plane, as they do not act as radiating structures, but merely as pieces of transmission lines from which there should be as little radiative loss as possible.

To summarize, the present invention provides a means for providing greater bandwidth with a compact antenna. This is accomplished in two related steps. First, a top hat monopole antenna configuration is modified to reduce the Q of the antenna mode. In doing so, space becomes available within the volume previously occupied by the antenna element that can be exploited to realize matching network structures that enable broader bandwidth performance. The result is improved bandwidth with no change in antenna volume and no external matching circuitry. The basic top hat geometry allows well-known trade-offs between antenna size and bandwidth. The structures proposed herein allow these antennas to operate at bandwidths that approach more closely the theoretic performance bounds, with potential improvements of 20% to 30% in operational bandwidth. These broader bandwidth, compact antennas would be most helpful in applications including hand-held communication devices and space-limited situations such as artillery-delivered UGS. They could even prove useful as array elements for systems with less severe space constraints.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A monopole antenna, comprising:

a ground plane;

a vertically extending coaxial feed line passing through a feed hole in the ground plane;

a top hat in the shape of a disk connected to an inner conductor of the coaxial feed line, the top hat being spaced from and extending over at least a portion of the ground plane; and an extension that extends an outer conductor of the coaxial feed line above the ground plane toward the top hat, wherein an inside diameter of the extension is substantially the same as an inside diameter of the outer conductor of the coaxial feed line below the ground plane, and wherein a conductor separation in a radial transmission line formed by the extension and the top hat is substantially similar to a conductor separation in the coaxial feed line.

2. The antenna of claim 1, further comprising a matching network, wherein the matching network comprises a series stub.

3. The antenna of claim 2, wherein a waveguide defined by the series stub extends predominately in a horizontal direction.

4. The antenna of claim 2, wherein a waveguide defined by the series stub extends predominately in a vertical direction.

5. The antenna of claim 1, wherein the antenna operates in the gigahertz range.

6. The antenna of claim 2, wherein a structure incorporating the matching network is electrically connected to the ground plane and is not electrically connected to the top hat.

7. The antenna of claim 2, wherein the matching network extends only to a perimeter of the top hat.

8. The antenna of claim 1, wherein the antenna has a coaxial input.

9. An antenna, comprising:

a ground plane and circular shaped top hat disk, the top hat disk being driven by a coaxial input; and a matching network disposed between the ground plane and the top hat disk, a structure incorporating the matching network being in physical contact only with the ground plane, wherein the matching network comprises a waveguide that has at least one opening that is adjacent and below a periphery of the top hat disk, the structure incorporating the matching network effectively raising a feed-point of the coaxial input to a location above the ground plane.

10. The antenna of claim 9, wherein the matching network comprises a series stub.

11. The antenna of claim 9, wherein the waveguide extends predominately in a horizontal direction.

12. The antenna of claim 9, wherein the waveguide extends predominately in a vertical direction.

13. The antenna of claim 9, wherein the antenna operates in the gigahertz range.

14. The antenna of claim 9, wherein the structure incorporating the matching network is electrically connected to the ground plane.

15. An antenna, comprising:

a ground plane and circular shaped top hat disk, the top hat disk being driven by a coaxial input; and a matching network disposed between the ground plane and the top hat disk, wherein the matching network comprises a plurality of segments connected together at orthogonal intersections, at least one of the segments rising perpendicularly from the ground plane and effectively extending an opening through which a feed line to the top hat disk passes, and wherein the plurality of segments together form at least one waveguide that has at least one opening facing a bottom surface of the top hat disk.

* * * * *